United States Patent [19]

Battegazzore

[11] Patent Number: 4,830,207

[45] Date of Patent: May 16, 1989

[54] PILFER-PROOF CLOSURE FOR LIQUEUR BOTTLES AND THE LIKE

[75] Inventor: Piero Battegazzore, Alessandria, Italy

[73] Assignee: Angelo Guala S.p.A., Italy

[21] Appl. No.: 49,551

[22] Filed: May 12, 1987

[30] Foreign Application Priority Data

May 30, 1986 [IT] Italy ..... 20631 A/86

[51] Int. Cl.[4] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,488,655 | 12/1984 | Itsubo | 215/252 |
| 4,497,765 | 2/1985 | Wilde et al. | 215/252 |
| 4,520,939 | 6/1985 | Itsubo et al. | 215/252 |
| 4,592,476 | 6/1986 | Yasada | 215/252 |

FOREIGN PATENT DOCUMENTS

| | | |
|---|---|---|
| 0073334 | 3/1983 | European Pat. Off. . |
| 0149496 | 7/1985 | European Pat. Off. . |
| 56-74445 | 6/1981 | Japan . |

*Primary Examiner*—Donald F. Norton

*Attorney, Agent, or Firm*—Arnold, White & Durkee

[57] ABSTRACT

A pilfer-proof closure for liqueur bottles and the like, having the ability to retain its cylindrical shape indefinitely, irrespective of the angular setting it may take once applied by screwing it onto a bottle, comprises a cap-type stopper having on its inside an annular shoulder, a pilfer-proof band, a weakening line formed between the cap-type stopper and the pilfer-proof band, and a plurality of small tabs extending tangentially inwards of the band and being set apart by the weakening line.

4 Claims, 1 Drawing Sheet

PILFER-PROOF CLOSURE FOR LIQUEUR BOTTLES AND THE LIKE

This invention relates to a pilfer-proof closure for liqueur bottles and the like, being of a type which comprises a cap type of stopper formed with an annular shoulder on its inside, a pilfer-proof band, and a weakening line formed between the cap-type stopper and the pilfer-proof band.

As is known, pilfer-proof closures of the type outlined above are applied to bottles automatically as part of the bottle filling process. During application, the cap-type stopper is screwed onto a corresponding threaded section formed on the bottle neck, and a plurality of sawteeth formed on the band are caused to snap over sawteeth correspondingly formed on a section of the bottle neck. On opening the bottle for the first time, the cap-type stopper is screwed out, whilst the band is prevented from turning by the band sawteeth face engaging with the bottle sawteeth. Thus, the cap-type stopper is caused to break away from the pilfer-proof band along the weakening line.

Such prior closures, while being advantageous for many aspects and substantially achieving their objective, still have a drawback which is brought forward, where they are applied in an automated manner, by a situation whereby the band sawteeth stop perched on the bottle sawtooth tips instead of nesting in hollows therebetween. In that case, the closure is apt to settle in a stressed condition, and in particular to shortly afterwards lose its cylindrical outer shape and distort, at least at the band level, into a polygonal pattern.

It follows from the above that applied closures are dissimilar in outward appearance. The polygonally distorted ones are readily distinguishable from the regularly cylindrical ones, and convey an unfavorable impression of improper fitting, or at least of erratic batch production.

It is an object of this invention to provide a closure of the kind specified above, which has such constructional and performance features as to obviate the described drawback affecting similar prior closures.

This problem is solved by a closure according to the invention being characterized in that it comprises a plurality of small tabs extending inwards of the band tangentially thereof, each tab having a root and a free end.

These small tabs are advantageously separated by the weakening line.

Further features and the advantages of the closure according to the invention will become apparent from the following detailed description of a preferred embodiment thereof, given by way of illustration and not of limitation with reference to the accompanying drawing, where:

Figures 1, 2, 3:
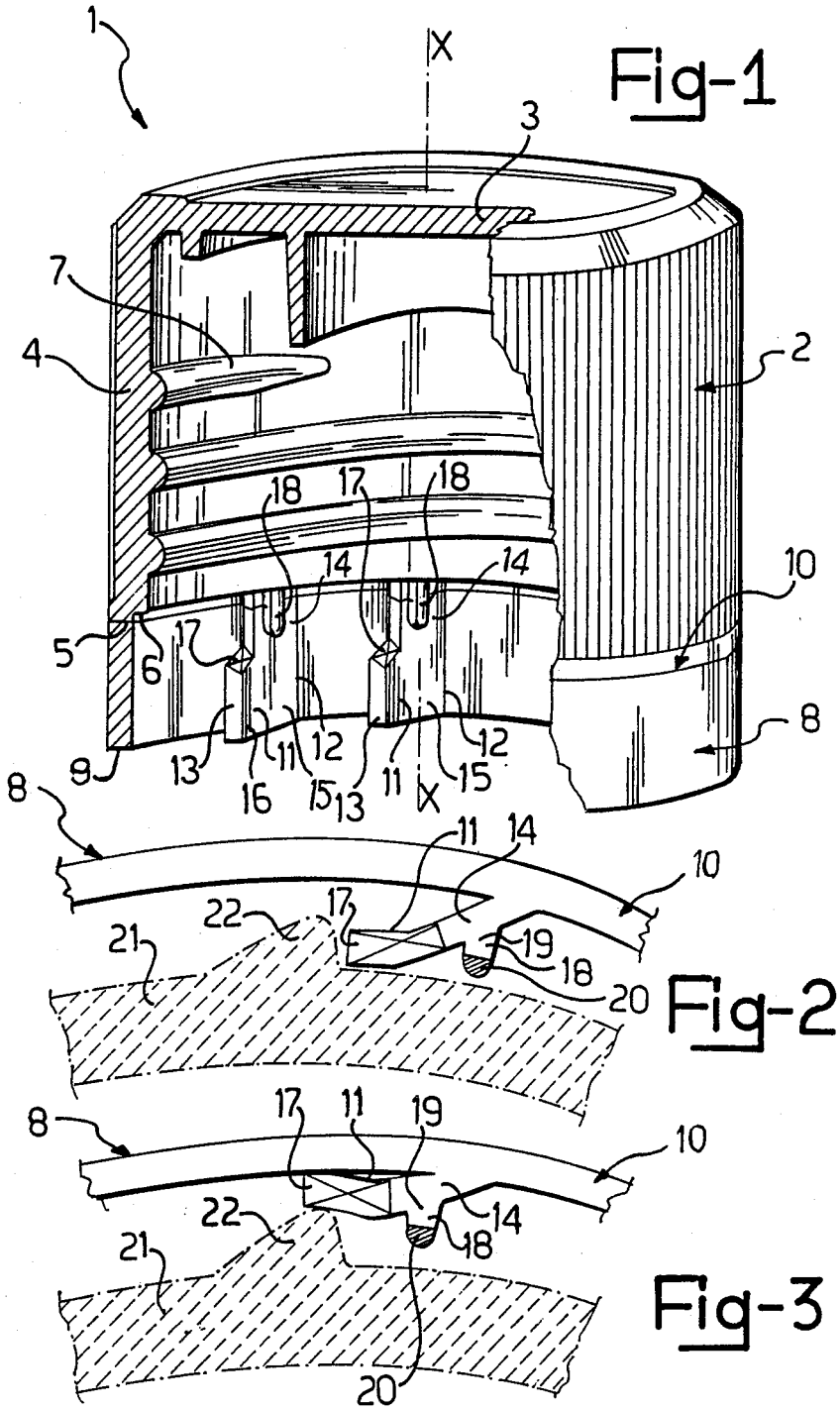
FIG. 1 is a cross-sectional perspective view of a closure according to this invention.
FIG. 2 is a cross sectional top view along the weakening line of a detail of the closure shown in FIG. 1, as applied to a bottle.
FIG. 3 is a cross sectional top view along the weakening line of the same detail of the closure shown in FIG. 2, as applied to a bottle but in a different annular relationship therewith.

With reference to the drawing figures, the numeral 1 designates generally a closure according to this invention.

The closure 1 comprises a cap-type stopper 2 having a bottom 3, a cylindrical skirt 4 about an axis X—X, and a rim 5.

In the vicinity of the rim 5, inwards on the skirt 4, there is formed an annular shoulder 6 facing the rim 5. Indicated at 7 is a thread formation on the skirt 4 inside which starts from the bottom 3 and extends as far as the shoulder 6 level.

The closure 1 further comprises a pilfer-proof band 8, which is annular in shape and extends in continuation of the skirt 4 from the rim 5 thereof up to a selected level, and has a free edge 9.

At 10 there is indicated a weakening line formed between the cap-type stopper 2 and the pilfer-proof band 8, which will be discussed in detail hereinafter.

The inventive closure 1 also comprises a plurality of small tabs, collectively indicated at 11, which are distributed at regular pitch intervals on the inside of the pilfer-proof band 8. Each tab 11 lies on a parallel plane to the axis X—X, has a root 12 and a free end 13, and extends inward at an acute angle with the tangent to the band 8 at the location the tab 11 is attached to the band 8.

The thickness dimension of a tab 11 is small relative to its length dimension, thereby the tab is elastically pliable in a radial direction but stiff in the axial direction.

Each tab 11 is axially spaced apart from the weakening line. In particular, each tab 11 is positioned axially in the band 8 from its free edge 9, and has a height dimension which varies from one half to two thirds of the band 8 height.

Advantageously, the closure 1 comprises for each tab 11 a plate-like rib 14, the thickness of said rib 14 being equal to the tab thickness and extending radially inward between a tab 11 and the shoulder 6 over a section 15 of the tab 11 which extends through a set distance from the root 12. More specifically, the length of the section 15 is equal approximately to one half the length of a tab.

Thus, the tab 11 is connected through the rib 14 and limited to its section 15 to the shoulder 6.

The tab 11 has, at a remaining section 16 thereof forming an extension of the section 15 as far as the free end 13, a face 17 confronting the shoulder 6, which slopes down toward the lower end of the pilfer-proof band 8.

Located at each rib 14, the closure of this invention also comprises a radially extending web formation 18 which juts out of the rib 14 toward the axis X—X over a short distance. The web formation 18 extends in an axial direction from the shoulder 6 toward the tab 11 across the weakening line 10.

More specifically, the weakening line 10 is in the form of a continuous circumferential cut made between the cap-type stopper 2 and the pilfer-proof band 8, said cut also extends into the web formation 14 and extending radially across a portion, indicated at 19, of the web formations 18, the remainder of the web formations 18, indicated at 20, forming a frangible bridge which interconnects the cap-type stopper 2 and pilfer-proof band 8.

It should be noted that the closure 1 as described is advantageously a unitary construction, molded from a suitable synthetic resin such as polypropylene.

The operation of the closure according to the invention will be described herein below with reference to a starting condition, shown in FIG. 2, wherein the closure is being applied to a bottle 21, as represented by just a section of its neck formed with sawteeth 22.

The closure 1 is applied to the bottle neck by screwing it onto the neck itself. In the course of this operation, the tabs 11 will climb up and snap over the sawteeth 22. In case a situation is met whereby, on completion of the closure screwing in step, each tab 11 is located at just a respective sawtooth 22 of the bottle, the tab 11 will be flexed in a radial direction and be disposed parallel to the band periphery. In this condition, as depicted in FIG. 3, no stressing occurs between the bottle and closure.

The main advantage of the closure according to the invention is that it will retain its cylindrical configuration irrespective of the attitude taken by the closure in its installed condition.

A further important advantage of the inventive closure is that it lends itself to high rate and inexpensive manufacture both as regards the molding procedure and provision of the weakening line.

The weakening line, in fact, is obtained by a single step of continuous circumferential cutting.

The molding procedure may be carried out with a simple mold incorporating no movable slides. In particular, during withdrawal of one of the plugs whereby the closure inside shaping is performed, the tab remainder section 16 will be urged elastically outwards by the exiting mold by virtue of the sloping face provided, as afforded by the spring action of the tab starting section and the rib.

Understandably, the closure disclosed hereinabove may be variously altered and modified by a skilled person in the art, in order to meet specific contingent requirements, without departing from the scope of the invention as set forth in the appended claims.

I claim:

1. A pilfer-proof closure for bottles, comprising:

an internally threaded cap having a rim at its base;

an annular shoulder extending circumferentially around the interior of said cap in the vicinity of the rim of said cap;

a pilfer-proof band extending from the rim of said cap;

a weakening line formed between said cap and said pilfer-proof band;

a plurality of tabs extending inward from the internal surface of said band, each of said tabs having a root end attached to said band and a free end;

a plurality of ribs, each of said ribs connected to the top of each of said tabs and extending radially inward a distance of approximately one half the length of said tabs; and a plurality of web formations, each of said web formations extending radially from each of said ribs and forming a frangible bridge interconnecting said cap and said band.

2. A pilfer-proof closure for liqueur bottles and the like which comprises:

a cap with depending skirt including an annular downfacing shoulder on the inner surface of the skirt, a pilfer-proof band, and a weakening line separating the pilfer-proof band from the lower end of the skirt;

a plurality of tabs circumferentially spaced around the inner wall surface of the band in axially spaced relation with said shoulder, and extending inward from said inner wall surface and in a direction contrary to the direction of rotation of said cap during closure;

a plurality of ribs, each of said ribs attaching each tab to the inner wall surface of the pilfer-proof band and extending axially across the weakening line to said shoulder; and a plurality of frangible webs, each of said webs attached to each said rib and extending radially inward of the band and axially between said shoulder and its respective rib.

3. A pilfer-proof closure according to claim 2 which further comprises a face on the upper surface of each said tab, said face confronting said shoulder and sloping downward toward the lower end of said pilfer-proof band.

4. A pilfer-proof band according to claim 2 wherein each of said tabs has an axial height from one-half to two-thirds of the height of said band.

* * * * *